United States Patent [19]

DeCorso et al.

[11] 3,943,705

[45] Mar. 16, 1976

[54] WIDE RANGE CATALYTIC COMBUSTOR

[75] Inventors: Serafino M. DeCorso, Media; Paul W. Pillsbury, Wallingford, both of Pa.

[73] Assignee: Westinghouse Electric Corporation, Pittsburgh, Pa.

[22] Filed: Nov. 15, 1974

[21] Appl. No.: 524,292

[52] U.S. Cl...... 60/39.74 R; 60/39.82 C; 60/39.65; 431/268

[51] Int. Cl.[2]..... F02C 7/22

[58] Field of Search..... 60/39.74 R, 39.65, 39.82 C, 60/39.69, 39.71; 431/268, 7

[56] References Cited

UNITED STATES PATENTS

| | | | |
|---|---|---|---|
| 2,635,426 | 4/1953 | Meschino | 60/39.71 |
| 3,153,323 | 10/1964 | Hamm | 60/39.71 |
| 3,182,472 | 5/1965 | Toone et al. | 60/39.82 C |
| 3,653,207 | 4/1972 | Stenger et al. | 60/39.65 |

*Primary Examiner*—William L. Freeh
*Assistant Examiner*—Thomas I. Ross
*Attorney, Agent, or Firm*—F. A. Winans

[57] ABSTRACT

A catalytic combustor arrangement for use with a gas turbine power plant, has independently regulatable fuel injection elements disposed upstream of a discrete array of passageways disposed between the fuel injection elements and a catalytic reaction member. The centermost fuel injection elements of each combustor may function alone which will permit efficient idling operation of the power plant. The passageways will maintain the flow of fuel and air to only the central portion of each catalytic reactor element thus providing the efficient, low speed, idling, operation of the turbine. As additional fuel injection elements are activated, additional portions of the catalytic reaction member perform the combustion function at the desired level of turbine operation. Thus a wide range of operating conditions of the gas turbine is efficiently permitted with the regulatable fuel injection arrangement therewith.

3 Claims, 5 Drawing Figures

WIDE RANGE CATALYTIC COMBUSTOR

BACKGROUND OF THE INVENTION

1. Field of the Invention

This invention relates generally to combustors, and more particularly to a catalytic combustion chamber arrangement for gas turbine power plants.

2. Description of the Prior Art

This case is related to Westinghouse Case 44,633 of S. M. DeCorso and P. W. Pillsbury and application Ser. No. 482,911 of common assignee.

Combustion chambers for gas turbines, have been comprised of annular arrays of cylindrically shaped burners or cans. Each combustion chamber or can, would have a single fuel injection nozzle and a spark plug, disposed at its upstream end. Air passageways would be disposed throughout the walls of the can to provide combustion air and to cool the walls of the combustor. U.S. Pat. No. 3,657,883 of S. M. DeCorso and assigned to the present assignee, shows an annular array of combustors disposed with a gas turbine.

As combustors have become increasingly sophisticated, and, incidently, as environmental pollution laws have become more stringent, arrangements for reducing contaminants, and for producing desirable temperature profiles from exit orifices of the combustors have abounded. An example of a prior art combustor is shown in U.S. Pat. No. issued to DeCorso and Carlson, U.S. Pat. No. 3,702,058. This patent, assigned to the present assignee of the present invention, describes a double walled, stepliner combustor for providing and withstanding high burning temperatures. An example of early U.S. art is U.S. Pat. No. 2,285,944, wherein a burner for gaseous fuels utilizes refractory or catalytic material. U.S. Pat. No. 3,714,778 shows a fuel injection arrangement in a standard combustion chamber, but does not suggest individual regulation thereof, nor does it suggest catalysts and discrete fuel injection and ignition with portions therewith.

SUMMARY OF THE INVENTION

A gas turbine power plant has a compressor section in which there is disposed at least one combustor or combustion chamber in its combustion arrangement, and a turbine section. The combustion arrangement is comprised of an annular array of combustor cans, or a fully annular combustor each combustor arrangement having an array of variable fuel injection members disposed at its upstream end, a catalytic reactor portion at its mid-section, and a bundle-like array of tubular passageways disposed therebetween. The tubular passageways in the combustion chambers alternately may be comprised of concentric rings, having an array of variable fuel injection members disposed at their upstream end. The tubular concentric passageways or the annular rings are upstream of the catalytic reactor member. The concentric tubular members or the bundle-like array of tubular members define separate passageways for the flow of fuel and air jetted therethrough. The fuel injectors are provided with variable output, and only a portion of the array of fuel injectors may be activated to direct fuel to a portion of the catalytic reaction member for oxidation therewith, providing ideal idling for the turbine when desired. When a slightly higher running speed of the turbine is needed, an additional array or system of fuel injection members are activated. The respective passageways between the activated fuel injection members or systems permits proportionate oxidiation of fuel in limited areas of the catalytic reaction member. This permits a high efficiency in fuel used, and a reduction in pollutants and fuel consumption.

It is an object, therefore, of the present invention to provide a catalytic combustor that is capable of wide range operation with very efficient fuel consumption associated therewith.

It is an additional object of the present invention, to provide a catalytic combustor for a gas turbine, wherein there are a plurality of fuel injection systems, each individually activatable, to permit oxidation with selective portions of the catalytic reaction member.

DESCRIPTION OF THE DRAWINGS

Further objects and advantages of the invention will be realized when viewed with the following drawings in which.

DESCRIPTION OF THE PREFERRED EMBODIMENT

Figure 1:
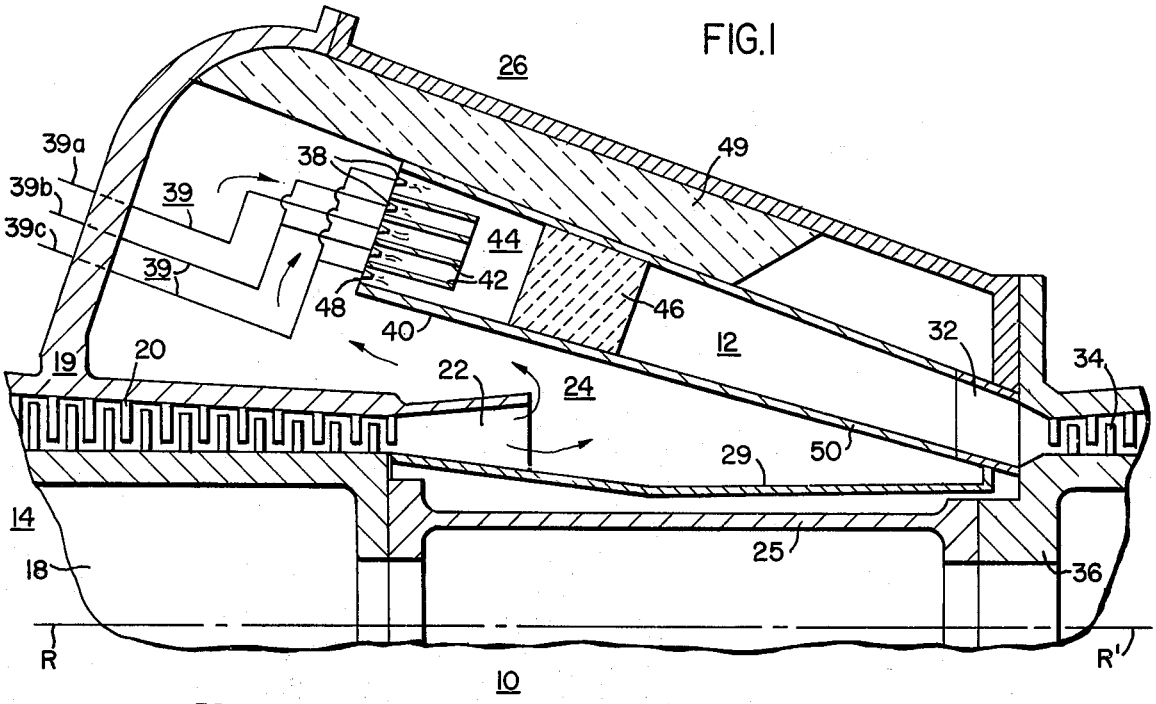
FIG. 1 is a longitudinal cross-sectional view of a portion of a gas turbine power plant showing a catalytic combustor and fuel injection arrangement constructed according to the principles of this invention.

Referring to the drawings in detail, and particularly to FIG. 1 there is shown a portion of a gas turbine power plant 10, having a combustion arrangement 12. The combustion arrangement 12 may be employed with any suitable gas turbine power plant. The gas turbine power plant 10 shown, includes an axial flow air compressor 14 for directing air to the combustion arrangement 12, and a gas turbine 16 connected to the combustion arrangement 12 and receiving hot products of combustion therefrom for motivating the power plant 10.

Only the upper half of the power plant 10 including the combustion arrangement 12 has been shown, since the lower half may be substantially identical and symmetrical about the center line or axis of rotation RR′ of the power plant 10.

The air compressor 14 includes, as well known in the art, a multi-staged bladed rotor structure 18 cooperatively associated with a stator structure 19 having an equal number of multi-stage stationary blades 20 for compressing the air directed therethrough to a suitable pressure value for combustion in the combustion arrangement 12. The outlet of the compressor 14 is directed through an annular diffusion chamber 22 forming an intake for a plenum chamber 24, partially defined by a housing structure 26. The housing 26 includes a shell member 27 of circular cross-section, and is shown generally parallel with the axis of rotation RR′ of the power plant 10, and with a forward dome-shaped wall member 28 connected to the external casing at the compressor 14.

The turbine 16, as mentioned above, is of the axial flow type and includes a plurality of expansion stages formed by a plurality of rows of stationary blades 32 cooperatively associated with an equal plurality of rotating blades 34 mounted on a turbine rotor 36. The turbine rotor 36 is drivingly connected to the compressor rotor 18 by a tubular shaft member 25, and a tubular liner or fairing member 29 is suitably supported in encompassing stationary relation with the connecting shaft portion 25 to provide a smooth air flow surface for the air entering the plenum chamber 24 from the compressor diffuser 22.

Figure 2:
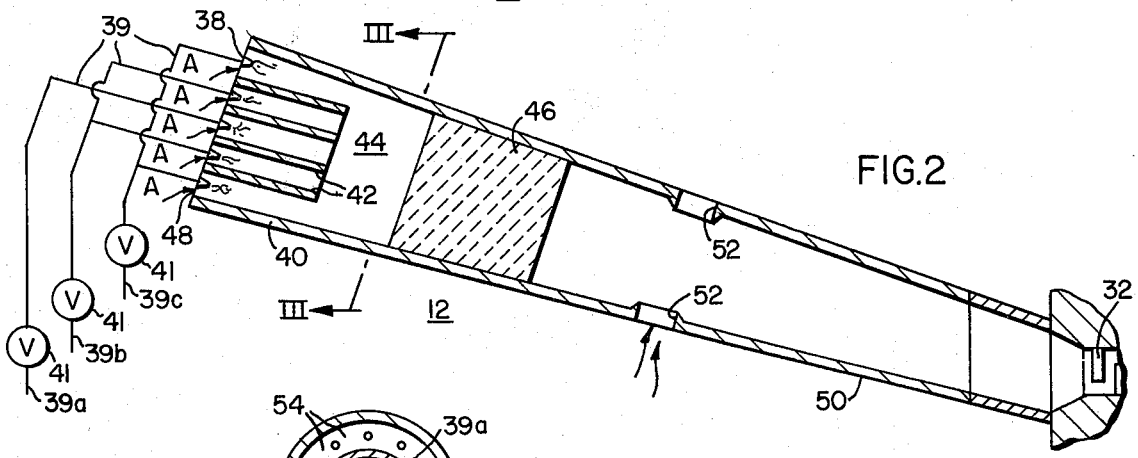
FIG. 2 is a longitudinal cross-sectional view of the combustor passageway and fuel injection arrangement.

Disposed within the housing 26 are a plurality of fuel injection nozzles 38 or members, which supply fuel to the combustion arrangement 12. Each fuel injection nozzle 38 is part of a fuel injection system 39, three of which are shown in this example, 39*a*, 39*b* and 39*c*, as depicted in FIGS. 1 and 2. The preferred embodiment comprises an annular array of cylindrical cannisters, 40, shells, combustors or cans, at the upstream end of which are disposed the fuel injection nozzles 38. Disposed generally coaxially and concentrically within said can 40, are a plurality of baffles 42 or tubular members in a spaced relationship with one another which define passageways 44 for fuel and air to pass within the combustor 40. Downstream of the baffles 42, there is disposed a catalytic reaction member 46. The catalytic reaction member 46 may be generally cylindrically shaped or otherwise arranged as shown in copending application by Pillsbury and DeCorso. The catalytic reaction member may be constructed from TORVEX, a ceramic material comprised of about 96% alpha Alumina, 3% Magnesium Aluminate Spinel and about 1% Mullite. The Mullite is essentially $3AL_2O_3 \cdot 2SiO_0$. TORVEX is a trademark of the Dupont Company.

In operation, say for example, during low speed or idling operation of the turbine, only one axially centermost fuel injection system 39*a*, possibly injection fuel at a reduced rate, would be functioning. Utilizing only the innermost of the passageways 44, the fuel may be directed to a central portion of the catalytic reaction member 46. Air inlets 48 are disposed about each of the fuel injection nozzles 38. The fuel and air mix within the passageways 44 until the mix reaches the catalytic reaction member 46. There catalytic combustion occurs. In this central portion of the catalytic reaction member 46, the fuel-air ratio is rich enough to cause the catalytic member 46 to become hot. Because of the catalyst, combustion therein is very efficient, with minimal unburned or partially burned products of combustion and the combustion temperature remains relatively low preventing the formation of nitrogen compounds. The zones of the catalytic reaction member 46 not receiving a fuel-air mix, receive only air. As more overall heat is required, the zone of the catalytic reaction member 46 receiving a fuel-air mix is broadened by activating the other fuel-injection systems, 39*b* and/or 39*c*. At high load conditions, the entire catalytic reaction member 46 receives a full fuel-air mix from all the fuel-injection systems 39.

There may be insulation material 49 disposed between the combustion arrangement 12 and the housing shell 27 to reduce any cooling requirements otherwise needed. Downstream of the catalytic reaction member 46, there is a transition portion 50 of the combustor can 40 which guides the hot products of the catalytic reaction to the vanes 32 and 34 of the turbine 16.

FIG. 2 shows a more detailed view of the combustion arrangement 12, wherein the combustor or can 40, may have an array of orifices 52 downstream of the catalytic reaction member 46 for admitting dilution air into the transition member 50. The dilution air provides temperature profiling and proper mixing of the hot products of the catalytic reaction. As shown on FIG. 2, air indicated by the arrows marked A, enters through the air inlets 48 which are fluid flow passageways or openings arranged about the fuel injection nozzles 38. Each fuel line has a valve arrangement 41 for variable and shut off control of fuel therethrough.

Figure 3:
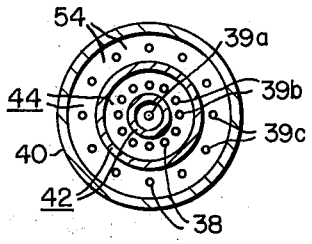
FIG. 3 is a view taken along the lines III—III of FIG. 2.
Figure 4:
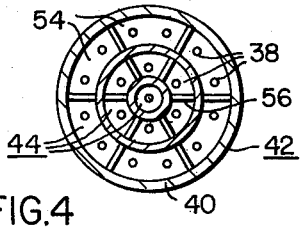
FIG. 4 is an alternative embodiment of the fuel passageway arrangement.

A view directed upstream in the combustor 40 is shown in FIGS. 3 and 4. FIG. 3 shows the baffles 42 as coaxial tubular members which define longitudinally extending annular passageways 44 therebetween. The baffles 42 prevent the intermixing of fuel-air from one passageway 44 with an air-only flow coming through a radially adjacent passageway 44 when the power plant 10 is running at less than full capacity. FIG. 4 shows a slight modification of the baffles 42 wherein an array of radially directed plates 56 divide the flow of fuel-air in each passageway 44 into arcuately shaped longitudinally extending volumes that permit selective fuel injection when the power plant 10 is running at less than full capacity. The radially directed plates 56 may further divide the flow of fuel and air in case circumferentially adjacent fuel injection nozzles 38 are intentionally not operating for absolute minimization of fuel regulation.

Figure 5:
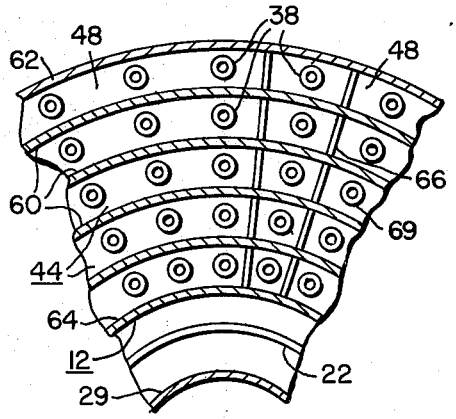
FIG. 5 is an alternative embodiment showing annularly disposed rings across the entire combustor area instead of individual combustor cans.

Another embodiment of the combustion arrangement 12 is shown in upstream directed view of FIG. 5, wherein there is no annular array of individual combustor cans 40, but a continuing annular arrangement of coaxial baffle members 60 disposed in a radially directed spaced relationship to one another and which encircle the entire plenum chamber 24 within shell 26. That is, the entire combustion arrangement 12 is comprised of generally coaxial rings. A longitudinal sectional view of FIG. 5 would be similar to the view of FIG. 1. An outermost ring 62 and an innermost ring 64 define a support structure for the baffle members 60 arranged therebetween. Passageways 44 are defined between baffle members 60. At the upstream end of the combustor arrangement 12, are disposed the fuel injection nozzles 38 and air inlets 48. The right side of FIG. 5 shows the baffles 60 with an array of radially directed longitudinally extending plates 66 disposed therebetween. These aid in guiding the fuel-air and plain air in flowing to the catalytic reactor member 46, as typified by that shown in FIGS. 1 and 2. With this arrangement, the annular array of fuel-injection nozzles 38 indicated by 69, would comprise that system 39*a*, utilized to function for lowload or idling operation of the power plant 10.

The use, therefore, of a plurality of fuel injection systems, each comprising an array of fuel injection nozzles, each system being capable of independent control and use, in conjunction with a catalytic reaction member and distinct fuel-air or air directing passageways therebetween permits efficient-economical use and wide range use of gas turbine engines. The reduction of heat otherwise produced means reduction in pollutants such as oxides of nitrogen.

Since numerous changes may be made in the above described construction, and different embodiments of the invention may be made without departing from the spirit and scope thereof, it is intended that all the matter contained in the foregoing description or shown in the accompanying drawings, shall be interpreted as illustrative and not in a limiting sense.

We claim:

1. A combustor arrangement comprising:

a combustor shell having an upstream air receiving portion and a combustor discharge end;

a catalytic reactor member disposed within said shell intermediate said upstream portion and said discharge end;

a plurality of coaxial tubular passageways extending from adjacent said upstream portion to generally adjacent said catalytic reactor member, said passageways providing airflow communications therebetween;

means for injecting fuel into each passageway so as to restrict the delivery of fuel to a confined area of said catalytic reactor member generally coextensive with the adjacent area of the tubular passageway receiving the fuel;

valve means for selectively regulating the flow of fuel to the injecting means to thereby supply fuel to any of said passageways and associated coextensive coaxial areas of catalytic reactor member;

whereby, supplying fuel to the fuel injecting means of the passageway closest to, or including, the axis of said coaxial passageways exposes the minimum area of said catalytic reactor member to support combustion and supplying fuel to the fuel injecting means of all said passageways exposes the maximum area of said catalytic reactor member to support combustion.

2. Structure according to claim 1 wherein said fuel injecting means of each coaxial tubular passageway is independently regulatable from the fuel injecting means of any one of said passageways through said valve means.

3. Structure according to claim 2 wherein said fuel injecting means within any one of said passageways is so disposed to generally uniformly provide fuel to the coaxial area of the catalytic reactor member associated with the respective passageway.

* * * * *